US008125495B2

(12) United States Patent
Darsa et al.

(10) Patent No.: US 8,125,495 B2
(45) Date of Patent: Feb. 28, 2012

(54) DISPLAYING USER INTERFACE ELEMENTS HAVING TRANSPARENT EFFECTS

(75) Inventors: Lucia Darsa, Clyde Hill, WA (US); Thomas Walter Getzinger, Redmond, WA (US); Jon Vincent, Seattle, WA (US)

(73) Assignee: Microsoft Corporation, Redmond, WA (US)

( * ) Notice: Subject to any disclaimer, the term of this patent is extended or adjusted under 35 U.S.C. 154(b) by 927 days.

(21) Appl. No.: 12/104,929

(22) Filed: Apr. 17, 2008

(65) Prior Publication Data

US 2009/0262122 A1 Oct. 22, 2009

(51) Int. Cl.
*G09G 5/02* (2006.01)

(52) U.S. Cl. ..... 345/592; 345/650

(58) Field of Classification Search ..... 345/592, 345/650

See application file for complete search history.

(56) References Cited

U.S. PATENT DOCUMENTS

| | | | | |
|---|---|---|---|---|
| 5,850,232 | A * | 12/1998 | Engstrom et al. | 345/539 |
| 6,088,018 | A | 7/2000 | DeLeeuw | 345/156 |
| 6,118,427 | A | 9/2000 | Buxton | 345/113 |
| 6,121,981 | A | 9/2000 | Trower, II | 345/473 |
| 6,353,450 | B1 | 3/2002 | DeLeeuw | 345/768 |
| 6,359,631 | B2 | 3/2002 | DeLeeuw | 345/629 |
| 6,384,821 | B1 | 5/2002 | Borrel | 345/421 |
| 6,396,473 | B1 | 5/2002 | Callahan | 345/113 |
| 2004/0075670 | A1 | 4/2004 | Bezine | 345/619 |
| 2004/0257369 | A1 | 12/2004 | Fang | 345/501 |
| 2005/0019015 | A1 | 1/2005 | Ackley | 386/95 |
| 2006/0061597 | A1 * | 3/2006 | Hui | 345/629 |
| 2007/0011713 | A1 | 1/2007 | Abramson | 725/113 |

OTHER PUBLICATIONS

"Graphics and Video Hardware Considerations," Microsoft Corporation, pp. 1-4, 2008, http://msdn2.microsoft.com/en-us/library/aa456299.aspx.

Gyllstrom, Karl, et al., "Facetop: Integrated Semi-Transparent Video for Enhanced Natural Pointing in Shared Screen Collaboration," May 15, 2005, Department of Computer Science—University of North Carolina at Chapel Hill, pp. 1-10, http://rockfish.cs.unc.edu/pubs/TR05-010.pdf.

* cited by examiner

*Primary Examiner* — Xiao M. Wu
*Assistant Examiner* — Maurice L McDowell, Jr.
(74) *Attorney, Agent, or Firm* — Merchant & Gould

(57) ABSTRACT

Embodiments are configured to provide information for display. Various embodiments include processing functionality that can be used to efficiently process pixel data associated with video, graphical, and other information. The functionality can be used in conjunction with different hardware and/or software architectures and configurations. In an embodiment, a computing device includes functionality to use a distinct window having alpha and occlusion features that can be used when processing pixel data associated with user interface (UI) elements and video, but is not so limited. The computing device can use the distinct window to display user interface elements having different levels or amounts of transparency as part of video capture and playback operations.

16 Claims, 9 Drawing Sheets

DISPLAYING USER INTERFACE ELEMENTS HAVING TRANSPARENT EFFECTS

BACKGROUND

Computing devices, including handheld mobile devices, have become essential tools for business and personal uses. Advances in computing power and storage capacity continue to enhance graphics and video processing capabilities. For example, handheld devices are now capable of providing multimedia experiences which can include combinations of text, audio, still images, animation, and video. Processing techniques have been developed which include the use of both hardware and software in attempting to efficiently present video and other graphical objects on a display.

SUMMARY

This summary is provided to introduce a selection of concepts in a simplified form that are further described below in the Detailed Description. This summary is not intended to identify key features or essential features of the claimed subject matter, nor is it intended as an aid in determining the scope of the claimed subject matter.

Embodiments are configured to provide information for display. Various embodiments include processing functionality that can be used to efficiently process pixel data associated with video, graphical, and other information. The functionality can be used in conjunction with different hardware and/or software architectures and configurations. In an embodiment, a computing device includes functionality to use a distinct window having alpha and occlusion features that can be used when processing pixel data associated with user interface (UI) elements and video, but is not so limited. The computing device can use the window when displaying user interface elements having different levels or amounts of transparency as part of video capture and/or playback operations.

These and other features and advantages will be apparent from a reading of the following detailed description and a review of the associated drawings. It is to be understood that both the foregoing general description and the following detailed description are explanatory only and are not restrictive of the invention as claimed.

DETAILED DESCRIPTION

Embodiments are configured to provide pixel data for displaying video, graphical, and/or other information. Various embodiments include functionality to efficiently process pixel data associated with video, graphical, and other information. The functionality can be used with different hardware and/or software architectures and configurations. For example, the functionality can be used with hardware architectures having and not having overlay support. In an embodiment, a computing device includes functionality to use an overlay window when processing pixel data associated with user interface (UI) elements and video, but is not so limited. For example, the overlay window can be used when processing semi-transparent menu items as part of a video capture or playback process. The computing device can use features of the overlay window when preparing to display UI elements having different levels or amounts of transparency as part of video capture and playback operations.

In one embodiment, a handheld computing device includes an operating system (OS) and display functionality to process pixel data associated with video and UI elements having varying levels or amounts of transparency. The handheld computing device can use features of an overlay window to efficiently process pixel data. For example, a portable computing device, such as a camera phone having video processing functionality, can use features of the overlay window to present pixel data associated with UI elements having transparent properties while playing or recording video, wherein the associated pixel data can include differing update rates and times as compared with the video. As further example, the overlay window can be used to present semi-transparent UI elements to allow video to show through the UI elements or to fade one or more UI elements in and out.

Figure 1:
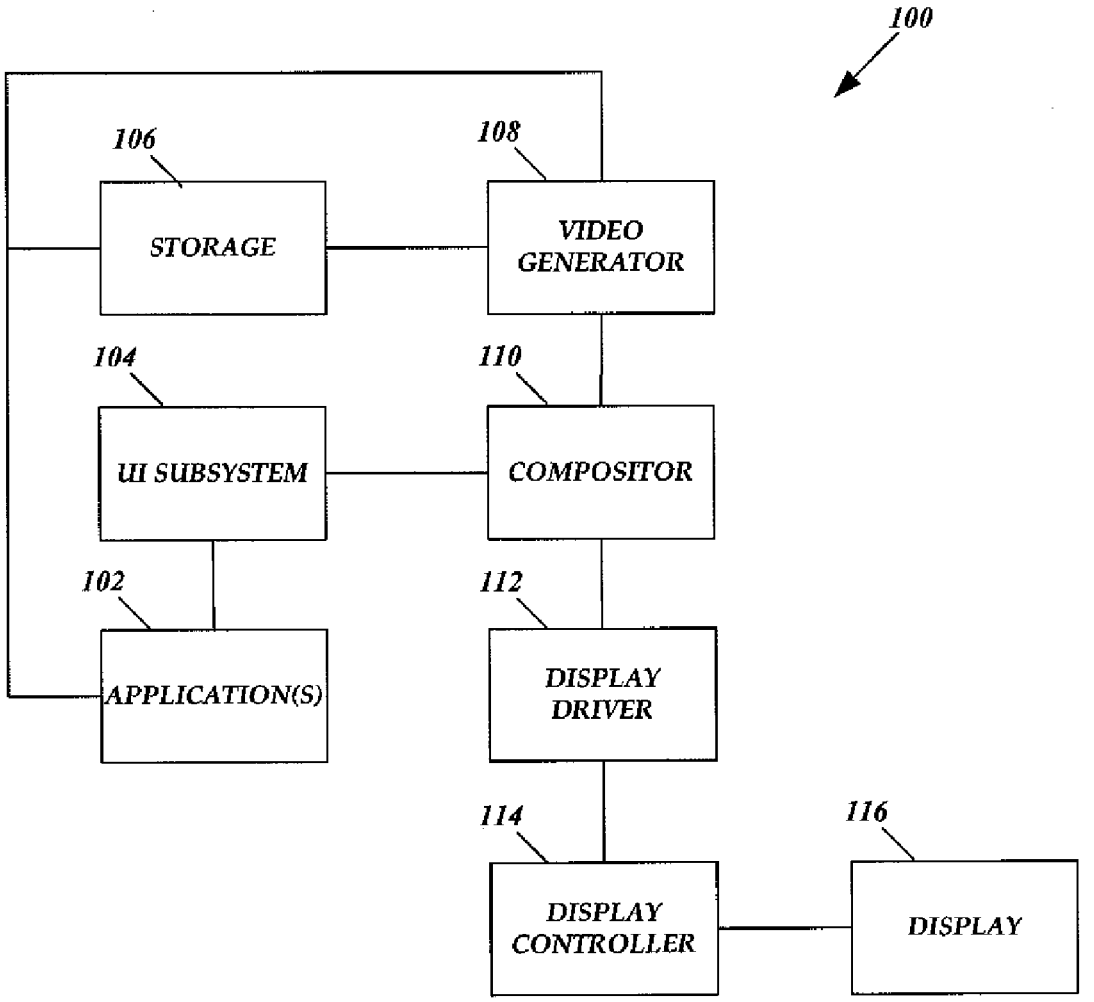
FIG. 1 is a block diagram of an example system to process and display pixel data.

FIG. 1 is a block diagram of a system 100 that can be used to process pixel data and other information, according to an embodiment. As described below, components of the system 100 can be configured to use different hardware and/or software features when processing pixel data to display UI elements having varying degrees of transparency with video. Components of the system 100 can operate to process pixel data to efficiently display icons, text, animations, and other graphical information having varying degrees of transparency with video. For example, a handheld device can include components of the system 100 to display the playback or recording of video along with UI elements, such as menu text, menu icons, and other UI functionality without affecting the video frame rate and/or UI element update rate. Components of the system can operate to process pixel data across a range of hardware and/or software capabilities, as described below.

As shown in FIG. 1, the system 100 includes a number of applications 102, a user interface (UI) subsystem 104, storage 106, a video generator or renderer 108, a compositor 110, a display driver 112, a display controller 114, and a display 116. As described below, the compositor 110 can use an overlay window for compositing operations based in part on the hardware and/or software functionalities of an associated computing device. For example, components of the system 100 can be incorporated into a handheld computing device or other computing system and used to process pixel data to display video and one or more UI elements having transparency information. Correspondingly, and as described further below, components of the system 100 can employ a variety of compositing and other features based in part on the capabilities of hardware and/or software of an associated computing device.

With continuing reference to FIG. 1, the one or more application 102 can generate and communicate commands, including requests, and other information to the UI subsystem 104 and/or the video generator 108. One or more of the applications 102 can refer to areas or memory locations of storage 106 as part of a communication or other operation. Components of the system 100 can also use storage 106 to designate one or more buffers to perform pixel operations and display pixel data. The storage component 106 can be a local store, a remote store, or some combination thereof for storing information. For example, the storage 106 can include network-based storage, random access memory (RAM) including video and system RAM, read-only memory (ROM), flash memory, hard disk storage, and/or other types of memory and storage capacity. As described below, a number of buffers can be used as part of processing video and UI element pixel data when presenting information for display, such as when displaying a video stream and one or more UI elements having varying amounts of transparency on a device display.

As described briefly above, one or more of the applications 102 can operate to generate and communicate commands and other information to the video generator 108 and/or the UI subsystem 104. The video generator 108 operates to generate video frames comprising a form of pixel data which can be stored in a buffer or other memory. In some cases, pixel data can include overlay information for displaying a video in a video overlay. A hardware overlay can use a dedicated area of memory or buffer when displaying video. The embodiments described herein can also be used in conjunction with multiple overlays.

The video generator 108 receives application and other commands, and can also use information from storage 106 to generate video display signals, such as a pixel data stream, in the form of a sequence of video frames consisting of video pixel data. For example, a digital video application may send commands to the video generator 108 to generate video associated with a video playback or capture operation. The application can send information to the video generator 108 such as a data source location associated with video pixel data in storage 106, transform, and compression information for generating a displayable video stream.

The application may also send commands, pixel data, and other information associated with one or more UI elements, such as a playback timer, file title, interactive controls and menus, display location and size, etc. to the UI subsystem 104 for display with the video during the video playback or capture operation. For example, an application can communicate x position, y position, size, color, z-order, and alpha information for one or more UI elements to the UI subsystem 104. The application can also communicate the location of a window to display a video stream comprising video pixel data.

As described above, as part of a communication, an application can also provide information associated with a video data source (e.g., network storage, from the device, RAM, flash, etc.) to the video generator 108 so that it can output the associated video stream. Other applications also may be communicating commands, pixel data, and other information to the UI subsystem 104 associated with UI elements for display, such as display windows and application interface data associated therewith. While certain examples are discussed herein, the functionality of the system is not so limited and can be used in conjunction with various applications and systems.

After receiving the commands, pixel data, and other information, the UI subsystem 104 can organize the pixel data and presentation information and feed it to the compositor 110 for compositing and other operations. The UI subsystem 104 maintains information associated with interactive elements being displayed on the display 116. For example, the UI subsystem 104 monitors and tracks open windows, including the associated UI elements, being used by a user of a computing device. The UI subsystem 104 also includes functionality to create and track an overlay window requested by an application, wherein the overlay window can be used when processing and presenting one or more UI elements having varying amounts of transparency with video. The UI subsystem 104 can be configured to create and track an overlay window using the dimensions and position information requested by an application, wherein the overlay window can be created to coincide with a hardware overlay that is being used to display a video stream, as described below. For example, the UI subsystem 104 can operate to create an overlay window having the same size and location as a hardware overlay that is being used to display video for an application, such as video being captured or played back.

In an embodiment, the UI subsystem 104 can be configured to create an overlay window having distinct alpha and occlusion properties or features when an application requires video capture or playback operations. For example, the UI subsystem 104 can operate to create a window having associated alpha and occlusion parameters that can be used to combine one or more UI elements having transparency properties with a video stream being captured or played. Correspondingly, the alpha and occlusion properties of the overlay window can be used when processing pixel data, including video and UI element pixel data.

In one embodiment, the overlay window can be defined to include an alpha value of zero with occlusion properties so that co-located pixels having lower z-values will be occluded by the overlay window. As a result, an alpha value of zero can be loaded into the composition buffer for each pixel that is associated with the overlay window. The overlay window can be used by the compositor 110 when processing pixel data so that UI elements having varying amounts of transparency can be efficiently processed and presented with video, but is not so limited. For example, the overlay window can be processed by the compositor 110 as part of presenting interactive controls and menus having alpha values greater than zero and less than one on top of a video stream being displayed on a device display.

In one embodiment, when an update or change occurs to pixel data, as part of its processing functionality, the compositor 110 can operate to process pixel data associated with one or more of the back buffers for inclusion into the composition buffer using a number of dirty rectangle blit operations. The one or more back buffers, composition buffer, and primary buffer can be configured as sections or portions of memory that can be used for processing pixel data. For example, local memory, such as RAM, can be partitioned into a number of buffers which a graphics chip can use when rendering pixel data associated with a frame or other presentation technique.

After processing the one or more back buffers, the compositor 110 can then operate to copy portions of the composition buffer into the primary buffer through a number of dirty blit operations for minimally sized rectangles. In one embodiment, the UI subsystem 104 can track dirty rectangles by maintaining a list of rectangles whose content has been modified by one or more applications (e.g., dirty). In another embodiment, the UI subsystem 104 can track dirty rectangles by tiling the primary surface into a number of tile elements and tracking which tile elements are out of date. The dirty rectangle/tiling information can be sent to the compositor 110 for use in processing the associated pixel data.

With continuing reference to FIG. 1, the display driver 112 is configured to generate commands based in part on the capabilities of the display controller hardware. The display driver 112 receives instructions and other information from the compositor 110 for use in generating commands to the display controller 114 when displaying pixel data on the display 116. The compositor 110 can communicate a set of instructions to the display driver 112 which can be used by the display controller 114 to program the associated hardware. That is, the display driver 112 can use the set of instructions to generate hardware specific instructions or commands based in part on the capability of the display controller 114 hardware.

The display controller 114 can use the commands to generate the ultimate set of pixel data that will be displayed in the display 116. For example, the display controller 114 can use commands generated by the display driver 112 to control aspects of the display 116 by using a primary display buffer and an overlay buffer to display information, such as video streams, animations, text, icons, and/or other display data, if the associated computing device includes the hardware capability.

As described briefly above, the compositor 110 can perform different processing operations based in part on the hardware and/or software capabilities of an associated computing device. For example, the compositor 110 can operate to process pixel data according to a pixel processing operation based in part on whether a display controller includes alpha channel functionality for blending operations or includes color keying functionality for mixing operations. In an embodiment, the compositor 110 can be configured to process and present pixel data associated with a number of allocated back buffers as one combined view. For example, the compositor 110 can operate to process updates associated with a video frame, a UI element, or some combination thereof, to provide a composed view which can be stored and updated using an allocated composition buffer.

In one embodiment, the compositor 110 can operate to process pixel data associated with each of the back buffers in reverse z-order to provide a combined view that can include one or more UI elements having varying amounts of transparency and video. The compositor 110 can use a composition buffer to maintain the combined view. As part of the processing operations, the compositor 110 can identify whether a buffer is opaque (having pixel data with alpha values equal to one) or includes transparency effects (having pixel data with alpha values greater or equal to zero and less than one).

If a buffer includes opaque pixel data, the compositor 110 can operate to copy the contents of the associated back buffer directly to the composition buffer. If the compositor 110 determines that a buffer is transparent, the compositor 110 can operate perform a per-pixel computation to combine pixel values from the associated back buffer with the current composed view as stored in the composition buffer. The composition buffer can then be updated with the computed pixel values.

In one embodiment, a flag can be used by the compositor 110 to identify an overlay window including identifying the associated alpha and occlusion properties. For example, when an application intends to display video as part of a playback or capture operation, the application can communicate with the UI subsystem 104 that an overlay window is required by the application. The overlay window can be configured to be co-located with an overlay and used to present UI pixel data having varying amounts of transparency. As part of the communication, the application can set a flag to identify the overlay window as having alpha values of zero, and also identifying that an associated back buffer is to be treated as being opaque.

When a processing operation is required, during an update for example, the compositor 110 can check the flag before processing the pixel data to determine whether to treat an associated back buffer as being opaque or transparent. If the flag is set, the compositor 110 treats the overlay window as opaque even though the associated pixel data contains alpha values of zero. The compositor 110 will operate differently on the composition buffer depending on the capabilities of the hardware.

As described herein, embodiments are configured to process and present one or more UI elements having varying amounts of transparency with video. For example, one or more UI elements having varying amounts of transparency can be processed and displayed with video on a computing device, such as a desktop, laptop, camera, desktop, smart phone, personal data assistant (PDA), ultra-mobile personal computer, or other computing or communication device. Moreover, components of system 100 described above can be implemented as part of networked, distributed, and/or other computer-implemented and communication environments. The system 100 can be employed in a variety of computing environments and applications. For example, the system 100 can used with computing devices having networking, security, and other communication components configured to provide communication functionality with other computing and/or communication devices.

While a computing architecture is shown in FIG. 1, functionality of various components can be also combined. For example, the functionality of the display driver can be included with the compositor and/or the display controller. As another example, the functionality of the compositor can be included as part of the UI subsystem. As further example, in some cases, the composition buffer can serve as the primary buffer. Additionally, the various embodiments described herein can be used with a number of applications, systems, and other devices and are not limited to any particular implementation or architecture.

Moreover, certain components and functionalities can be implemented in hardware and/or software. While certain embodiments include software implementations, they are not so limited and they encompass hardware, or mixed hardware/software solutions. Also, while certain functionality has been described herein, the embodiments are not so limited and can include more or different features and/or other functionality. Accordingly, the embodiments and examples described herein are not intended to be limiting and other embodiments are available.

FIGS. 2A-2D are flow diagrams which depict a process for processing pixel data, under an embodiment. For example, the process can be used to display information, such as video, animation, text, icons, and/or other display data. The components of FIG. 1 are used in describing the flow diagrams, but the embodiment is not so limited. As described below, the process can be used to display one or more UI elements having varying amounts of transparency (e.g., interactive menus, tools, and/or other features) with video based in part on the hardware and/or software capabilities of an associated computing device, but is not so limited.

Figure 2A:
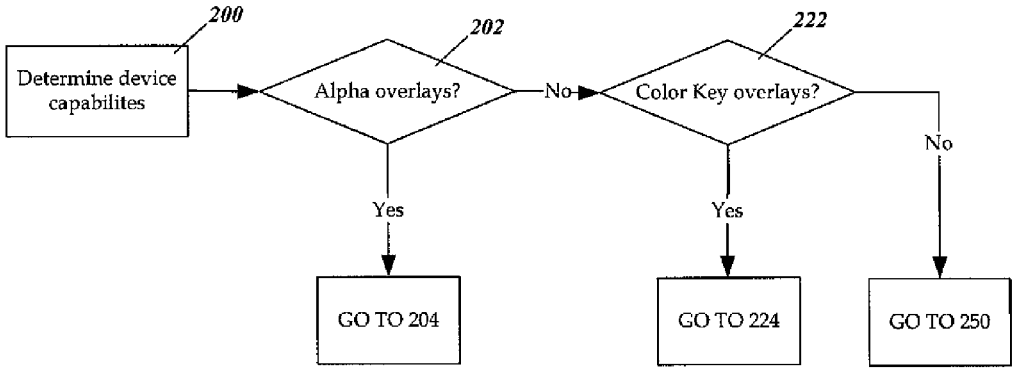
FIGS. 2A-2D are flow diagrams which illustrate an exemplary process of processing pixel data for display.

Referring to FIG. 2A, at 200, the hardware and/or software capabilities for displaying video, graphical, and other information are determined for an associated computing device. For example, the operating system (OS) can detect hardware and/or software capabilities, such as overlay hardware, alpha hardware, color key hardware, etc. when the device is powered on or booted up. As another example, the OS can determine the hardware and/or software capability and availability when a user opens an application (local, networked, or web-based applications) in order to play a video. As further example, the device can include inherent hardware and/or software detecting functionality (e.g., display driver) to determine the associated hardware and/or software capability and availability.

Figure 2B:
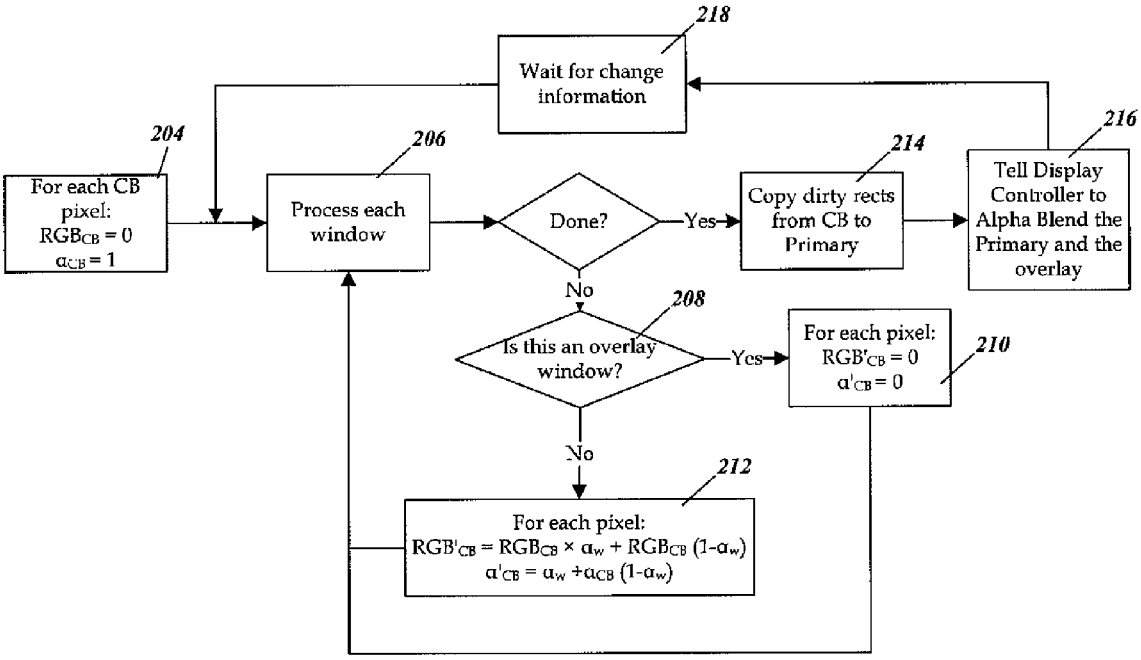

At 202, if the device includes overlay and alpha blending hardware, the flow proceeds to 204 (FIG. 2B). Overlay support coupled with alpha blending enables video to be displayed without the cost of blending video and UI elements into the primary surface. When using an overlay, an application can specify where the overlay is going to show in the final display so that the one or more UI elements and video can coexist. As described below, the compositor 110 can track UI elements so that they can be blended appropriately over the video at the UI update rate with a new video frame or when a UI element is updated (e.g., moved, closed, etc.). The compositor 110 can perform a series of dirty rectangle blit operations when managing pixel information from the composition buffer to a primary buffer. The dirty rectangle blit operations can be used to update changed pixels, such as pixels that have changed from a prior time and/or frame.

If the device includes alpha blending hardware, the compositor 110 can operate to determine final alpha values for UI element pixel data that is to be superimposed with video pixel data. The compositor 110 can communicate alpha values to the display controller 114 for use when performing alpha blending in the device hardware to produce a final composed view for the display 116. An example illustrating the determination of final alpha values for UI element pixel data having transparency effects that is superimposed with video pixel data is provided below with reference to FIG. 4 for a device that includes alpha blending hardware.

Referring to FIG. 2B, at 204, the compositor 110 begins by setting the red-green-blue (RGB) value equal to zero ($RGB_{CB}=0$) and alpha value equal to one ($\alpha_{CB}=1$) for each pixel of the composition buffer, and the flow proceeds to 206. In various embodiments, the foregoing equations can use source pixel values having an unassociated format, source pixels having pre-multiplied pixel values, and/or other formats/values depending on the formats of associated buffers provided by the applications. At 206, the compositor 110 operates to process each window according to a processing order. In one embodiment, the compositor 110 can operate to process each window in z-order from back to front. As an example, the compositor can process a window when an application modifies, adds, or removes one or more UI elements which may affect other pixels in the composition buffer and final display view.

If the compositor 110 has not processed all windows and encounters an overlay window at 208, the flow proceeds to 210 and the compositor 110 operates to set the RGB value equal to zero ($RGB'_{CB}=0$) and alpha value equal to zero ($\alpha'_{CB}=0$) for each pixel in the composition buffer that is associated with the overlay window. As it acts as an opaque window, it will cover any previous content. The flow then returns to 206. Otherwise, at 212, the compositor 110 operates to calculate the RGB value ($RGB'_{CB}=RGB_{CB}*\alpha_w+RGB_{CB}*(1-\alpha_w)$) and alpha value ($\alpha'_{CB}=\alpha_w+(1-\alpha_w)*\alpha_{CB}$) for each pixel associated with the current window being processed and the flow returns to 206.

If there are no further windows to be processed, the flow proceeds to 214 and the compositor 110 operates to copy dirty rectangles from the composition buffer to the primary buffer. In an alternative embodiment, the compositor 110 can copy dirty tiles to the primary buffer when a tiling system is being used to process pixel data. At 216, the compositor 110 informs the display controller 114 to perform alpha blending operations using the pixel data of the primary buffer and the overlay. The flow proceeds to 218 and the compositor 110 waits for change information associated with the display view. For example, the compositor 110 can wait for the UI subsystem 104 or an application to communicate further changes associated with various pixel data. The flow again returns to 206.

Figure 2C:
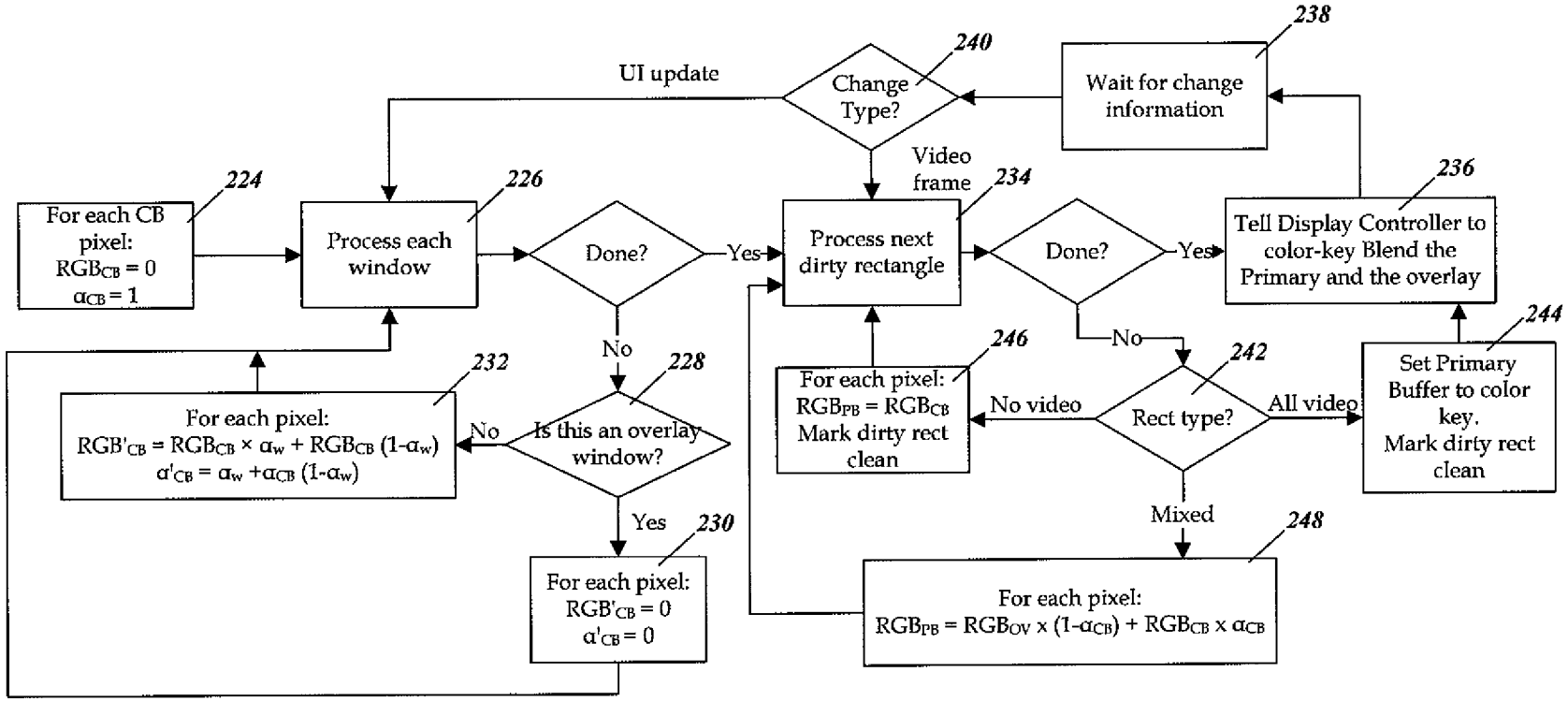

If the device does not include alpha hardware at 202, the flow proceeds to 222. If the device includes hardware that supports color keying functionality at 222, the flow proceeds to 224 (FIG. 2C). Color keying functionality can be used to present video associated with an overlay when the color keying hardware detects a pixel having a designated color (e.g., magenta) and an alpha value of zero (completely transparent). For this case, and as described below, the compositor 110 can operate to process the red-green-blue-alpha (RGBA) composition buffer to a RGB primary surface with color keying. Moreover, as described above, the compositor 110 can perform a series of dirty rectangle blit operations when managing pixel information from the composition buffer to a primary buffer. Alternatively, the compositor 110 can use a tiling system described above.

Before continuing with the description of FIG. 2C, in an embodiment, the video generator 108 can paint a color key in the primary surface to designate the location of an associated overlay for displaying video pixel data. An overlay window can be associated with overlay and used to process video and other pixel data. In one embodiment, the UI subsystem 104 can operate to create and track an overlay window requested by an application which can be co-located with the overlay on the primary surface. Correspondingly, the overlay window can be used to detect changes to the overlay and any UI elements having co-located pixel locations with respect to the overlay window. As described above, the UI subsystem 104 can set a flag which can be used to identify the alpha and occlusion properties associated with an overlay window. For example, when the UI subsystem 104 sets a flag to identify a window as an overlay window, the compositor 110 can read the flag and treat the associated window as being opaque for z-order operations and having alpha values equal to zero when performing compositing operations.

With continuing reference to FIG. 2C, at 224, the compositor 110 begins by setting the RGB value equal to zero ($RGB_{CB}=0$) and alpha value equal to one ($\alpha_{CB}=1$) for each pixel of the composition buffer, and the flow proceeds to 226. At 226, the compositor 110 operates to process each window according to a processing order. If the compositor 110 has not processed all windows and encounters an overlay window at 228, the flow proceeds to 230 and the compositor 110 operates to set the RGB value equal to zero ($RGB'_{CB}=0$) and alpha value equal to zero ($\alpha'_{CB}=0$) for each pixel in the composition buffer that is associated with the overlay window. The flow then returns to 226. Otherwise, at 232, the compositor 110 operates to calculate the RGB value ($RGB'_{CB}=RGB_{CB}*\alpha_w+RGB_{CB}*(1-\alpha_w)$) and alpha value ($\alpha'_{CB}=\alpha_w+(1-\alpha_w)*\alpha_{CB}$) for each pixel associated with the current window being processed and the flow returns to 226.

If there are no further windows to be processed, the flow proceeds to 234 and the compositor 110 operates to process the next dirty rectangle. If there are no further dirty rectangles to process, the flow proceeds to 236 and the compositor tells the display controller 114 to color key blend the pixel data associated with the primary buffer and the overlay. The flow proceeds to 238 and the compositor waits for further change information. If the compositor 110 receives a change notification associated with a UI element update at 240, the flow returns to 226.

If the compositor 110 receives a change notification associated with a video frame at 240, the flow proceeds again to 234 and the next dirty rectangle is processed in a processing order. For example, the compositor 110 can process each dirty rectangle in z-order. If the next dirty rectangle only includes video pixel data at 242, the flow proceeds to 244. At 244, the primary buffer is set to the color key and the compositor 110 marks the associated dirty rectangle as clean. The flow then proceeds again to 236.

If the next dirty rectangle includes no video pixel data at 242, the flow proceeds to 246. At 246, the compositor 110 operates to copy each pixel of the dirty rectangle from the composition buffer to the primary buffer and then marks the dirty rectangle as clean. If the next dirty rectangle includes video and UI pixel data (mixed pixel data) at 242, the flow proceeds to 248. At 248, the compositor 110 operates to calculate the RGB value ($RGB'_{PB}=RGB_{CB}*\alpha_{CB}+RGB_{OV}*(1-\alpha_{CB})$) for the primary buffer for each pixel associated with the current dirty rectangle. In one embodiment, the video generator 108 can operate to send the RGB value of the overlay to the compositor for the video pixels of the associated dirty rectangle. The compositor 110 then saves the calculated value for the current dirty rectangle and the flow again returns to 234.

Figure 2D:
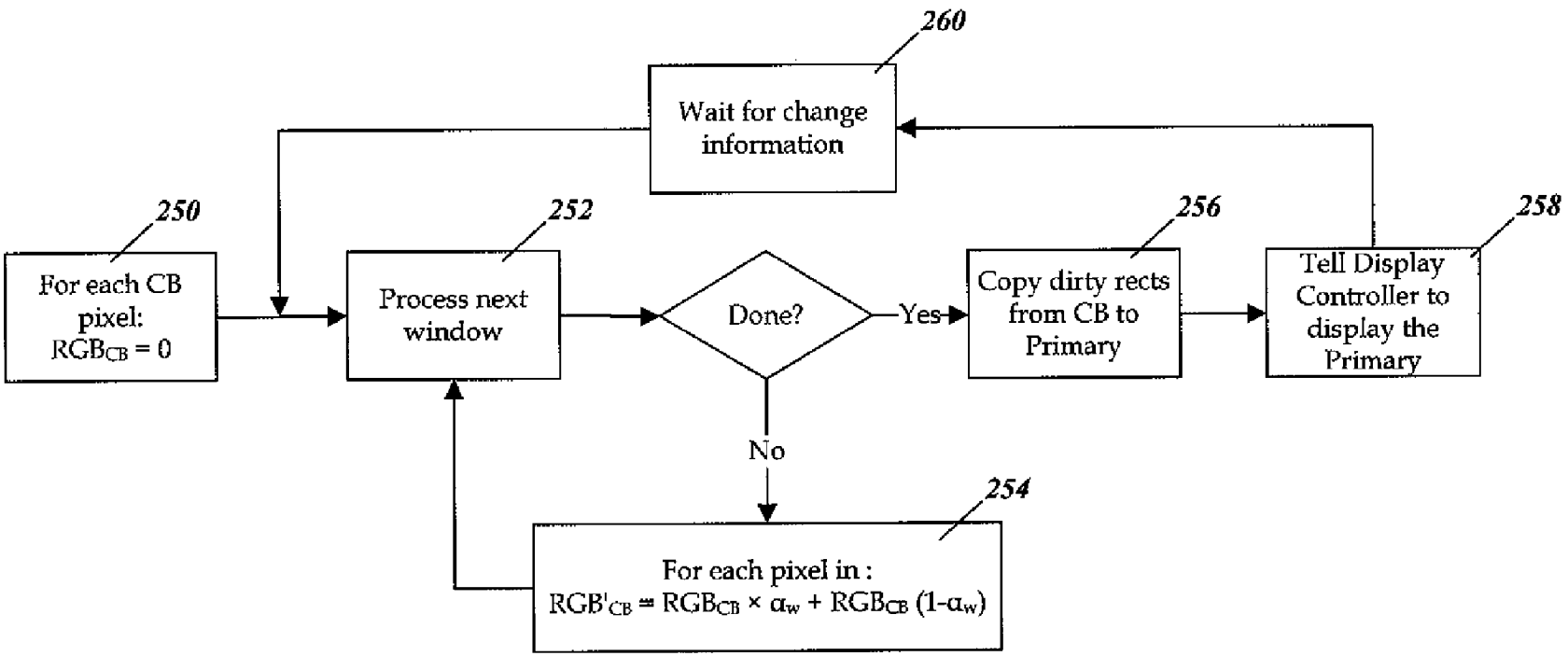

If the device does not include hardware that supports color keying or alpha blending functionality at 222, the flow proceeds to 250 (FIG. 2D). As shown in FIG. 2D, at 250, the compositor 110 begins by setting the RGB value equal to zero ($RGB_{CB}=0$) for each pixel of the composition buffer, and the flow proceeds to 252. At 252, the compositor 110 operates to process each window according to a processing order. If the compositor 110 has not processed all windows, at 254 the compositor 110 operates to calculate the RGB value ($RGB'_{CB}=RGB_{CB}*\alpha_w+RGB_{CB}*(1-\alpha_w)$) for each pixel associated with the current window being processed and the flow returns to 252.

If there are no further windows to be processed, the flow proceeds to 256 and the compositor 110 operates to copy dirty rectangles from the composition buffer to the primary buffer. At 258, the compositor 110 tells the display controller 114 to use the information of the primary buffer to display a display view. The flow proceeds to 260 and the compositor 110 waits for change information associated with the display view. The flow then returns to 252.

As described above, FIG. 2D illustrates a case when a device does not include overlay support and a UI element which includes an amount of transparency requires updating. For example, an application can request that one or more UI elements that are superimposed with video pixel data include transparency effects, including different amounts for each UI element or portions thereof. Since the device does not include overlay support, the display controller 114 is not able to perform composition operations. As a result, the compositor 110 has to perform compositing operations using the composition buffer. As part of the compositing operations, the compositor 110 can operate to update information stored in the composition buffer when the video generator 108 and/or the UI subsystem 104 require an update.

As a result, for this case, the video generator 108 will be writing to an opaque window. Accordingly, the video generator 108 can operate to blit video pixel data to the back buffer associated with the opaque window. Thereafter, the compositor 110 can operate to blit pixel data associated with any dirty rectangles from the opaque back buffer to the composition buffer. Then, the compositor 110 can operate to blit pixel data associated with each UI element having an amount of transparency from an associated back buffer to the composition buffer, including performing the appropriate blending operations while accounting for z-ordering. Finally, the compositor 110 can operate to blit pixel data associated with any dirty rectangles from the composition buffer to the primary buffer for use in displaying the pixel data on the display 116.

Figure 3:
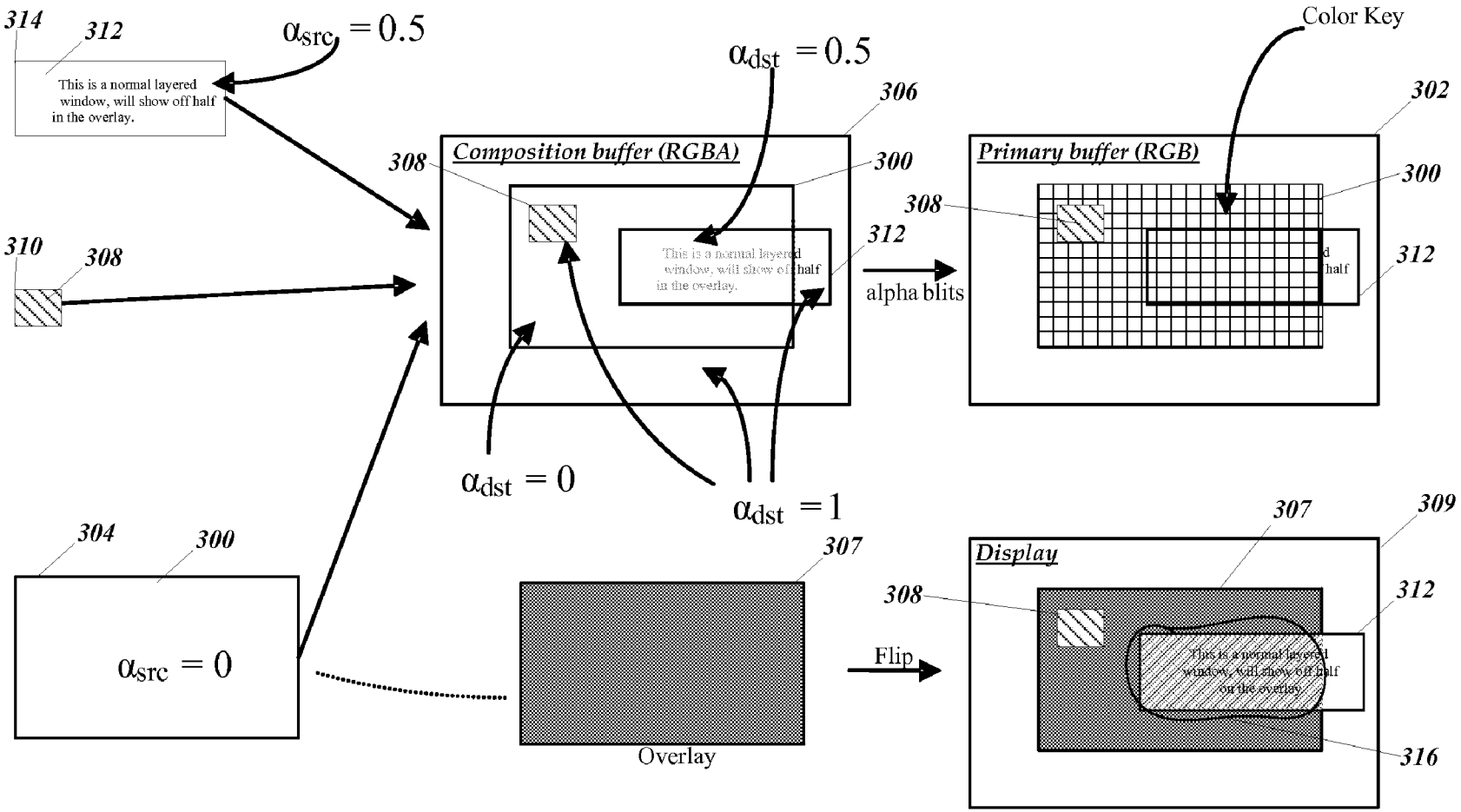
FIG. 3 is a block diagram illustrating an example of processing pixel data with color keying functionality.

Referring now to FIG. 3, an example is shown for a device which includes hardware that supports color keying functionality. Again, the components of FIG. 1 are used in the description of FIG. 3. As shown in FIG. 3, an overlay window 300 includes alpha source (back buffer 304) and alpha destination (composition buffer 306) values of zero ($\alpha_{src}=\alpha_{dst}=0$). In an alternate embodiment, the back buffer 304 is not required to support an overlay window and values of zero can be written directly to the composition buffer 306 for the pixels associated with the overlay window 300. For example, an application can request an overlay window as part of a video capture operation. If an update affects the overlay window, no additional processing will be required for the overlay 307 and the associated video pixel data is presented in the overlay 307 in the final display 309 because of the color keying information.

If an update affects an opaque rectangle or an opaque UI element 308, the compositor 110 can update the primary buffer 302 for the opaque UI element 308 by performing a blit operation to strip the alpha channel from the composition buffer 306 and convert the color component to screen format for the final display 309. As shown in FIG. 3, the opaque UI element 308 includes an alpha source (back buffer 310) and alpha destination (composition buffer 306) values of one ($\alpha_{src}=\alpha_{dst}=1$). No additional processing is required for the overlay 307, since it will be hidden by the color in the primary buffer 302. The opaque UI element 308 can include the color key as long as the opaque UI element 308 is not co-located with the overlay 307. However, the color key can be selected so that the opaque UI element 308 will be displayed over the video overlay 307.

If an update affects a regular layered window or rectangle having an amount of transparency (alpha greater than zero and less than one), such as UI element 312 which has an alpha source value of 0.5 ($\alpha_{src}=0.5$) in back buffer 314. In this case, the compositor 110 can blend the UI element 312 and the overlay 307 in overlapping areas so that the UI element 312 shows over or is superimposed with the video pixel data in the resulting display 309. As shown in FIG. 3, the composition buffer 306 now includes the UI element 312 which has an alpha destination value of 0.5 ($\alpha_{dst}=0.5$) for locations within the overlay window 300 and an alpha destination value of one for ($\alpha_{dst}=1$) for locations outside of the overlay window 300. The blending also occurs if the overlay 307 is updated (a flip operation) in the overlapping areas.

As described above, the compositor 110 use a list or other data structure to track dirty rectangles for subsequent processing. Correspondingly, the compositor 110 can track portions of the display 309 that need to be blended based in part on the associated alpha values and/or pixel location(s). After blending operations, the video pixel data will show through the UI elements which include an amount of transparency (see the border 316 surrounding the portion of the UI element 312 having an alpha value of 0.5) in the display 309, and no additional processing will be required on the overlay 307. If the results need to be re-blended, and if the overlay 307 has not changed, the overlay hardware can re-blend the results using the information in the composition buffer 306 and in the overlay 307. In each case, the display controller 114 can operate to combine the information of the primary buffer 302 and the overlay 307 based on the color keying, and send the processed result to the display 116.

In an alternative embodiment, the compositor 110 can use a tiling system to track updates. In this embodiment, the compositor 110 can operate to process the associated pixel data by calculating color and alpha values for the associated pixels and write the blended results to the primary buffer 302. For example, consider individual pixels. Opaque pixels with an alpha value of one will include the calculated color for the associated pixel locations of the composition buffer 306. Pixels associated with the overlay window 300 will have an alpha value of zero and will have the color from the overlay. Pixels having values greater than zero and less than one will result in a blended value.

Figure 4:
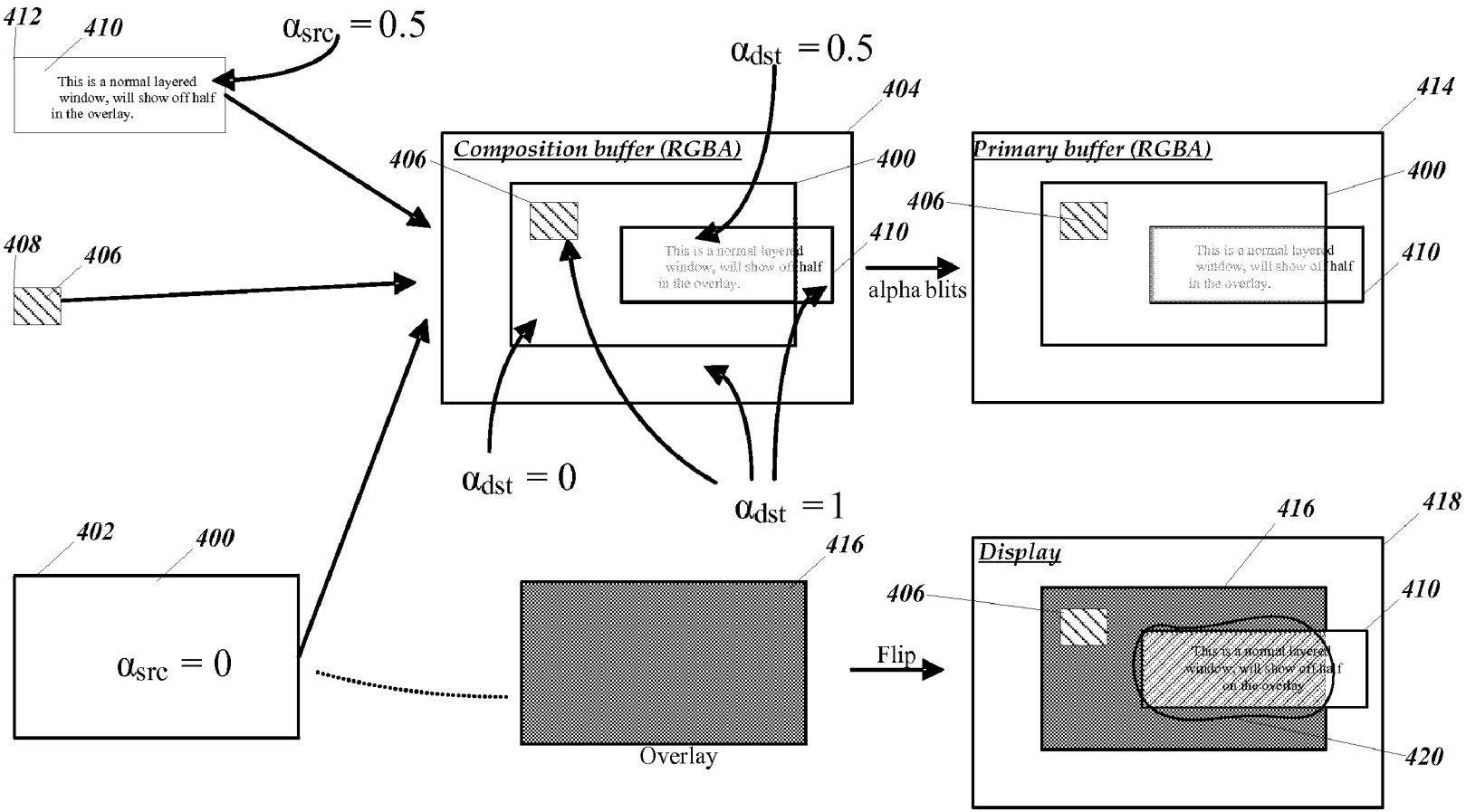
FIG. 4 is a block diagram illustrating an example of processing pixel data with alpha blending functionality.

Referring now to FIG. 4, an example is shown which illustrates pixel processing operations for a device that includes overlay support and alpha hardware. As shown in FIG. 4, an application has requested an overlay window 400 which includes an alpha source value of zero of zero ($\alpha_{src}$=0) (back buffer 402). The compositor 110 has operated to blit the overlay window 400 to the composition buffer 404 which includes an alpha destination value of zero ($\alpha_{dst}$=0). As described above, the overlay window 400 will occlude co-located pixel data having lower z-values. In an alternate embodiment, the destination zero alpha values can be written directly to the composition buffer 404.

An application (the same application or a different application) has also requested an opaque UI element 406 which includes an alpha source (back buffer 408) value of one ($\alpha_{src}$=1). The compositor 110 has operated to blit the opaque UI element 406 to the composition buffer 404 which includes an alpha destination value of one ($\alpha_{dst}$=1). An application (the same application or a different application) has requested a regular layered window or rectangle having an amount of transparency (alpha greater than zero and less than one), such as UI element 410 which has an alpha source value of 0.5 ($\alpha_{src}$=0.5) in back buffer 412. Since the UI element 410 includes an amount of transparency, the compositor 110 can operate to calculate the final alpha values associated with the superimposed UI element 410 in conjunction with the overlay window 400.

The compositor 110 can then write the final color values plus alpha to the primary buffer 414. The video pixel data associated with the video stream is written to the overlay 416. The display controller 114 can use the pixel data stored in the primary buffer 414, which includes color and alpha values, in combination with the video stream or pixel data of the overlay 416 to generate the final view on the display 418. Thereafter, the video stream will show through the UI elements which include an amount of transparency (see the border 420 surrounding the portion of the UI element 410 having an alpha value of 0.5) in the display 418. A similar set of operations are implemented when an update to a UI element or the overlay occurs. Accordingly, the compositor 110 can pass requests to update video pixel data to the display controller 114, while independently operating to update pixel data associated with UI elements.

Figure 5A:
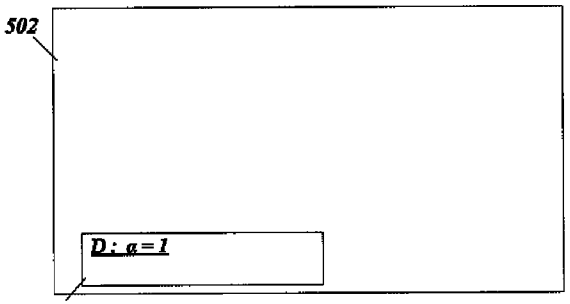
FIGS. 5A-5E are block diagrams which illustrate exemplary pixel processing operations for a device that includes overlay support and color keying functionality.

FIGS. 5A-5E provide an example of pixel processing operations for a device that includes overlay support and color keying functionality. As shown in FIG. 5A, an opaque UI element 500 (D: $\alpha$=1) has been added to the composition buffer 502. The resulting color and alpha values for the opaque UI element 500 can be determined as follows:

$$RGB'_{CB}=RGB_D*\alpha_D+RGB_{CB}*(1-\alpha_D)$$

$$\alpha'_{CB}=\alpha_D+(1-\alpha_D)*\alpha_{CB}$$

Figure 5B:
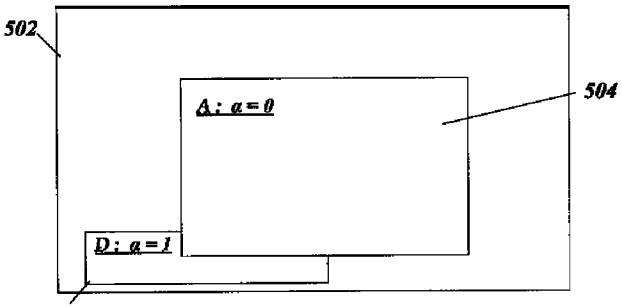

In FIG. 5B, an overlay window 504 (A: $\alpha$=0) has been added to the composition buffer 502. For example, an application that is going to present video pixel data can request an overlay window 504 which can be tracked by the UI subsystem using a tracking flag or other identifier. As shown in FIG. 5B, the overlay window 504 covers a portion of the UI element 500 since the overlay window 504 includes occlusion features. As described above, a flag can be used to identify pixel processing features associated with the overlay window 504. For example, the UI subsystem can set a flag for use in alpha blending operations, e.g., DDABLT_NOBLEND, that enables the loading of values, such as zero, into destination alpha and color components. After setting the flag, the resulting color and alpha values for the overlay window 504 can be set as follows:

$$RGB'_{CB}=0$$

$$\alpha'_{CB}=0$$

Figure 5C:
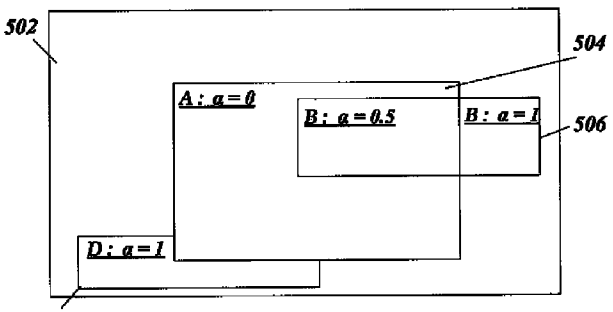

In FIG. 5C, UI element 506 having an amount of transparency (B: $\alpha_{src}$=0.5) has been added to the composition buffer 502. The resulting color and alpha values for the overlay window 504 can be determined as follows:

$$RGB'_{CB}=RGB_B*\alpha_B+RGB_{CB}*(1-\alpha_B)$$

$$\alpha'_{CB}=\alpha_B+(1-\alpha_B)*\alpha_{CB}$$

As shown in FIG. 5C, the UI element 506 has a destination alpha value of 0.5 for portions that are superimposed over portions of the overlay window 504, and a destination alpha value of 1.0 for the portions that do not.

Figure 5D:
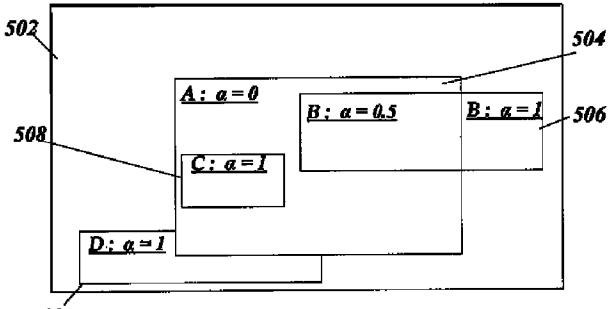

In FIG. 5D, another opaque UI element 508 (C: $\alpha_{src}$=1.0) has been added to the composition buffer 502. The resulting color and alpha values for the opaque UI element 508 can be determined as follows:

$$RGB'_{CB}=RGB_C*\alpha_C+RGB_{CB}*(1-\alpha_C) \rightarrow RGB'_{CB}=RGB_C$$

$$\alpha'_{CB}=\alpha_C+(1-\alpha_C)*\alpha_{CB} \rightarrow \alpha'_{CB}=1.0$$

Figure 5E:
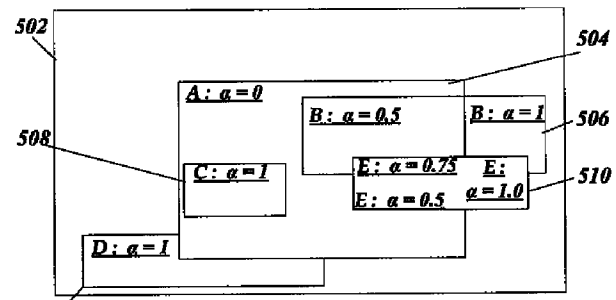

In FIG. 5E, UI element 510 having an amount of transparency (E: $\alpha_{src}$=0.5) has been added to the composition buffer 502. The resulting color and alpha values for the UI element 510 can be determined as follows:

$$RGB'_{CB}=RGB_E*\alpha_E+RGB_{CB}*(1-\alpha_E)$$

$$\alpha'_{CB}=\alpha_E+(1-\alpha_E)*\alpha_{CB}$$

As shown in FIG. 5E, the UI element 510 has a destination alpha value of 0.75 for portions that are superimposed over portions of the UI element 506, a destination alpha value of 0.5 for portions that are superimposed only over portions of the overlay window 504, and a destination alpha value of 1.0 for the portions that do not cover any other structures. After an update, the compositor can update the composition buffer 502 based in part on the type of structure being updated. The compositor can proceed with blit operations when updating an opaque UI element. The video generator can blit the color key when updating only video pixel data. For blended video or mixed structure situations, the compositor can save the blit regions for subsequent processing. The following calculation can be used for the saved regions:

$$RGB'_{SAVE}=RGB_{CB}*\alpha_{CB}+RGB_{overlay}*(1-\alpha_{CB})$$

The results can be written to the primary buffer and the overlay can be left unmodified. Alternatively, the color key can be written to the primary buffer and the results can be written to the overlay. For the mixed case, when the actual Flip( )s from the video generator occur (or the overlay requires updating), the regions with saved transparency data can be alpha blended by the compositor with the overlay data onto the primary surface and then the actual Flip takes place, showing the overlay where the color key is still present. The process can also be used when more than one video stream is being used (e.g., picture-in-picture (PIP) scenarios).

Figure 6A:
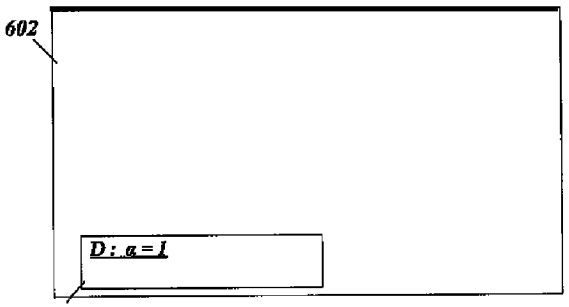
FIGS. 6A-6E are block diagrams which illustrate exemplary pixel processing operations for a device that includes overlay support and alpha blending hardware.

FIGS. 6A-6E provide an example of pixel processing operations for a device that includes overlay support and alpha blending hardware. As shown in FIG. 6A, an opaque UI element 600 (D: $\alpha=1$) has been added to the composition buffer 602. The resulting color and alpha values for the opaque UI element 600 can be determined as follows:

$$RGB'_{CB}=RGB_D*\alpha_D+RGB_{CB}*(1-\alpha_D)$$

$$\alpha'_{CB}=\alpha_D+(1-\alpha_D)*\alpha_{CB}$$

Figure 6B:
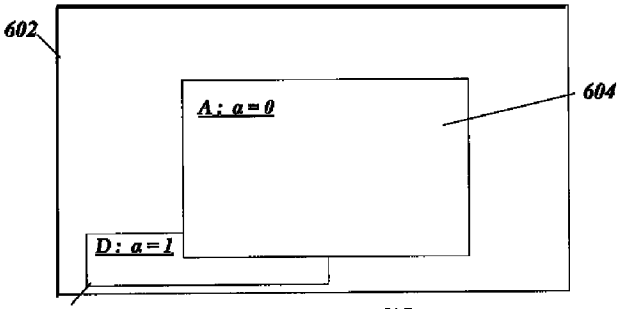

In FIG. 6B, an overlay window 604 (A: $\alpha=0$) has been added to the composition buffer 602. The overlay window 604 covers a portion of the UI element 600 since the overlay window 604 includes occlusion features. As described above, a flag can be used to identify the pixel processing features associated with the overlay window 604. For example, the UI subsystem can set a flag for use in alpha blending operations, e.g., DDABLT_NOBLEND, that enables the loading of values, such as zero, into destination alpha and color components. After setting the flag, the resulting color and alpha values for the overlay window 604 can be set as follows:

$$RGB'_{CB}=0$$

$$\alpha'_{CB}=0$$

Figure 6C:
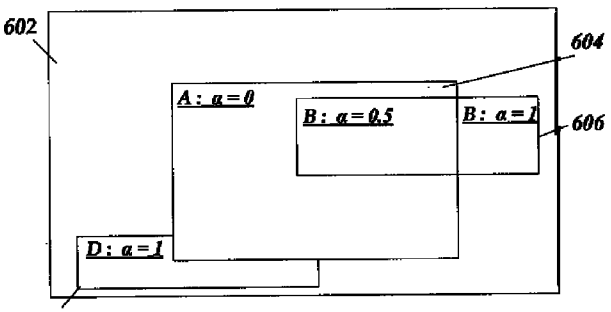

In FIG. 6C, UI element 606 having an amount of transparency (B: $\alpha_{src}=0.5$) has been added to the composition buffer 602. The resulting color and alpha values for the overlay window 604 can be determined as follows:

$$RGB'_{CB}=RGB_B*\alpha_B+RGB_{CB}*(1-\alpha_B)$$

$$\alpha'_{CB}=\alpha_B+(1-\alpha_B)*\alpha_{CB}$$

As shown in FIG. 6C, the UI element 606 has a destination alpha value of 0.5 for portions that are superimposed over portions of the overlay window 604, and a destination alpha value of 1.0 for the portions that do not.

Figure 6D:
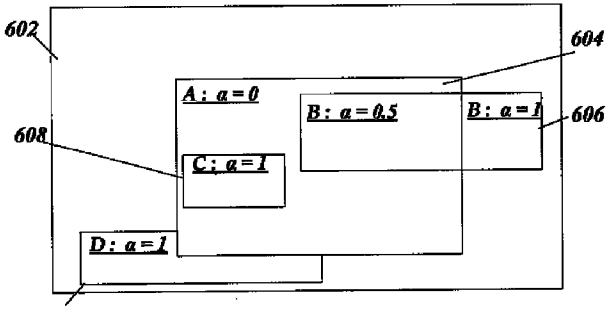

In FIG. 6D, another opaque UI element 608 (C: $\alpha_{src}=1.0$) has been added to the composition buffer 602. The resulting color and alpha values for the opaque UI element 608 can be determined as follows:

$$RGB'_{CB}=RGB_C*\alpha_C+RGB_{CB}*(1-\alpha_C) \rightarrow RGB'_{CB}=RGB_C$$

$$\alpha'_{CB}=\alpha_C+(1-\alpha_C)*\alpha_{CB} \rightarrow \alpha'_{CB}=1.0$$

Figure 6E:
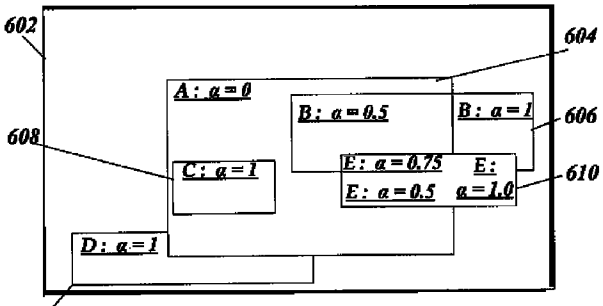

In FIG. 6E, UI element 610 having an amount of transparency (E: $\alpha_{src}=0.5$) has been added to the composition buffer 602. The resulting color and alpha values for the UI element 610 can be determined as follows:

$$RGB'_{CB}=RGB_E*\alpha_E+RGB_{CB}*(1-\alpha_E)$$

$$\alpha'_{CB}=\alpha_E+(1-\alpha_E)*\alpha_{CB}$$

As shown in FIG. 6E, the UI element 610 has a destination alpha value of 0.75 for portions that are superimposed over portions of the UI element 606, a destination alpha value of 0.5 for portions that are superimposed only over portions of the overlay window 604, and a destination alpha value of 1.0 for the portions that do not cover any other structures. For this case, since the device includes alpha blending hardware, the display driver has information about alpha in the primary buffer based on the above calculations. The display driver also has knowledge of the video pixel data. Therefore, the display driver can command the display controller to use the associated hardware to composite pixel data whenever updating information of the video overlay happens (e.g., a flip) or when updating information associated with the composition buffer 602.

While a certain order and number of operations are described with respect to the FIGURES, the order and/or number of operations and/or components can be modified according to a desired implementation. Accordingly, other embodiments are available.

Exemplary Operating Environment

Figure 7:
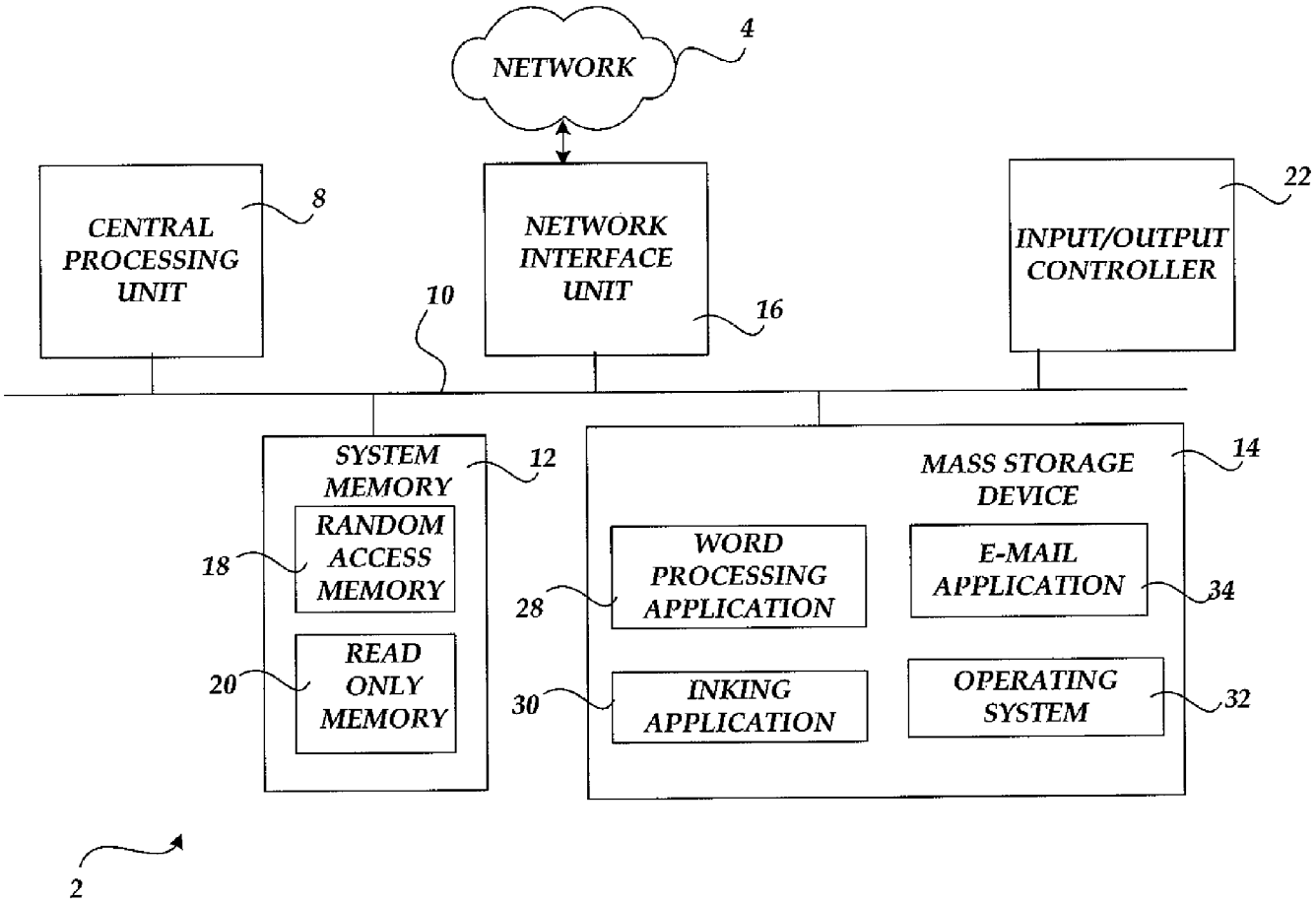
FIG. 7 is a block diagram illustrating an exemplary computing environment for implementation of various embodiments described herein.

Referring now to FIG. 7, the following discussion is intended to provide a brief, general description of a suitable computing environment in which embodiments of the invention may be implemented. While the invention will be described in the general context of program modules that execute in conjunction with program modules that run on an operating system on a personal computer, those skilled in the art will recognize that the invention may also be implemented in combination with other types of computer systems and program modules.

Generally, program modules include routines, programs, components, data structures, and other types of structures that perform particular tasks or implement particular abstract data types. Moreover, those skilled in the art will appreciate that the invention may be practiced with other computer system configurations, including handheld devices, multiprocessor systems, microprocessor-based or programmable consumer electronics, minicomputers, mainframe computers, and the like. The invention may also be practiced in distributed computing environments where tasks are performed by remote processing devices that are linked through a communications network. In a distributed computing environment, program modules may be located in both local and remote memory storage devices.

Referring now to FIG. 7, an illustrative operating environment for embodiments of the invention will be described. As shown in FIG. 7, computer 2 comprises a general purpose desktop, laptop, handheld, tablet, or other type of computer capable of executing one or more application programs. The computer 2 includes at least one central processing unit 8 ("CPU"), a system memory 12, including a random access memory 18 ("RAM"), a read-only memory ("ROM") 20, a textual store 25, and a system bus 10 that couples the memory to the CPU 8. A basic input/output system containing the basic routines that help to transfer information between elements within the computer, such as during startup, is stored in the ROM 20.

The computer 2 further includes a mass storage device 14 for storing an operating system 32, application programs, and other program modules. The mass storage device 14 is connected to the CPU 8 through a mass storage controller (not shown) connected to the bus 10. The mass storage device 14 and its associated computer-readable media provide non-volatile storage for the computer 2. Although the description of computer-readable media contained herein refers to a mass storage device, such as a hard disk or CD-ROM drive, it should be appreciated by those skilled in the art that computer-readable media can be any available media that can be accessed or utilized by the computer 2.

By way of example, and not limitation, computer-readable media may comprise computer storage media and communication media. Computer storage media includes volatile and non-volatile, removable and non-removable media implemented in any method or technology for storage of information such as computer-readable instructions, data structures, program modules or other data. Computer storage media includes, but is not limited to, RAM, ROM, EPROM, EEPROM, flash memory or other solid state memory technology, CD-ROM, digital versatile disks ("DVD"), or other optical storage, magnetic cassettes, magnetic tape, magnetic disk storage or other magnetic storage devices, or any other medium which can be used to store the desired information and which can be accessed by the computer 2.

According to various embodiments, the computer 2 may operate in a networked environment using logical connections to remote computers through a network 4, such as a local network, the Internet, etc. for example. The computer 2 may connect to the network 4 through a network interface unit 16 connected to the bus 10. It should be appreciated that the network interface unit 16 may also be utilized to connect to other types of networks and remote computing systems. The computer 2 may also include an input/output controller 22 for receiving and processing input from a number of input types, including a keyboard, mouse, keypad, pen, stylus, finger, speech-based, and/or other means. Other input means are available including combinations of various input means. Similarly, an input/output controller 22 may provide output to a display, a printer, or other type of output device. Additionally, a touch screen or other digitized device can serve as an input and an output mechanism.

As mentioned briefly above, a number of program modules and data files may be stored in the mass storage device 14 and RAM 18 of the computer 2, including an operating system 32 suitable for controlling the operation of a networked personal computing device, such as the WINDOWS operating systems from MICROSOFT CORPORATION of Redmond, Wash. for example. The mass storage device 14 and RAM 18 may also store one or more program modules. In particular, the mass storage device 14 and the RAM 18 may store other application programs, such as a word processing application 28, an inking application 30, e-mail application 34, drawing application, browser application, etc.

It should be appreciated that various embodiments of the present invention can be implemented (1) as a sequence of computer implemented acts or program modules running on a computing system and/or (2) as interconnected machine logic circuits or circuit modules within the computing system. The implementation is a matter of choice dependent on the performance requirements of the computing system implementing the invention. Accordingly, logical operations including related algorithms can be referred to variously as operations, structural devices, acts or modules. It will be recognized by one skilled in the art that these operations, structural devices, acts and modules may be implemented in software, firmware, special purpose digital logic, and any combination thereof without deviating from the spirit and scope of the present invention as recited within the claims set forth herein.

Although the invention has been described in connection with various exemplary embodiments, those of ordinary skill in the art will understand that many modifications can be made thereto within the scope of the claims that follow. Accordingly, it is not intended that the scope of the invention in any way be limited by the above description, but instead be determined entirely by reference to the claims that follow.

What is claimed is:

1. A method of processing pixel data comprising:

receiving input from one or more applications, wherein the input includes user interface (UI) pixel data and video pixel data;

determining display capabilities of an associated computing device including determining if an associated computing device includes alpha blending functionality;

generating a video frame using the video pixel data;

tracking an overlay window including alpha and occlusion features for identifying an area to display the video frame, wherein the alpha and occlusion features of the overlay window can be used when performing pixel processing operations;

generating one or more UI elements using the UI pixel data, wherein the one or more UI elements each include an amount of transparency;

superimposing the one or more UI elements with the video frame including calculating a blended alpha value and a color value for each of the one or more superimposed UI elements;

updating a composition buffer with new pixel data including using a predefined alpha value for blending operations with the overlay window and determining final alpha values in the composition buffer if the associated computing device includes alpha blending functionality; and;

outputting a display view based in part on the updated composition buffer for display.

2. The method of claim 1, further comprising setting a flag to identify the overlay window, wherein the flag can be referred to for blending operations with the overlay window.

3. The method of claim 1, further comprising loading a value of zero for the predefined alpha value of the overlay window in the composition buffer.

4. The method of claim 3, further comprising loading a color value of zero in the composition buffer for the overlay window.

5. The method of claim 1, further comprising generating the one or more UI elements using the UI pixel data, wherein the one or more UI elements include an amount of transparency having alpha values greater than zero and less than one.

6. The method of claim 1, further comprising generating the one or more UI elements using the UI pixel data, wherein the one or more UI elements include one or more interactive menu items.

7. The method of claim 1, further comprising blending the one or more superimposed UI elements with the video frame including calculating the alpha value and the color value for each pixel of the one or more superimposed UI elements, wherein the composition buffer includes alpha values of between zero and one for the one or more superimposed UI elements after updating the composition buffer.

8. The method of claim 1, further comprising generating the video frame using the video pixel data, wherein the video pixel data is associated with one of a video capture and playback operation.

9. The method of claim 1, further comprising determining if the associated computing device includes color keying functionality and painting a color key in a rectangle associated with the overlay window if the associated computing device includes color keying functionality.

10. The method of claim 9, further comprising updating a opaque UI element by performing a blit operation to strip the alpha channel from the composition buffer and converting an associated color component to screen format for the display if the associated computing device includes color keying functionality.

11. The method of claim 9, further comprising blending the one or more UI elements having each having the amount of transparency with an overlay if the computing device includes overlay functionality and color keying functionality, wherein pixel values associated with overlapping areas include alpha values of between zero and one.

12. The method of claim 1, further comprising updating the display using dirty rectangle operations.

13. The method of claim 1, further comprising processing the pixel data based in part on whether overlays are available and whether one or color keying and alpha blending hardware is available.

14. A system to process pixel data comprising:

a UI subsystem to generate a UI element having an amount of transparency and to create an overlay window having an alpha value of zero and occlusion properties;

a video generator to generate a video stream;

a compositor to combine the UI element with the video stream such that the video stream shows through the UI element having the amount of transparency, wherein the compositor can use the zero alpha of the overlay window when performing compositing operations; and, a display driver to generate hardware specific instructions based in part on the capability of display controller hardware when processing and generating pixel data for display including capability of one or more of overlay hardware, color keying hardware, and alpha blending hardware.

15. The system of claim 14, further comprising a primary buffer and a composition buffer, wherein the compositor can operate to perform a series of dirty rectangle blit operations when managing pixel information from the composition buffer to the primary buffer.

16. The system of claim 15, further comprising a display controller to process overlay information with the primary buffer content when displaying a display view.

* * * * *